United States Patent [19]

Yasue et al.

[11] 4,072,783

[45] Feb. 7, 1978

[54] METHOD FOR SURFACE TREATMENT OF STEEL SHEET AND STEEL SHEETS OBTAINED THEREFROM

[75] Inventors: Motoi Yasue; Yoshikazu Tagawa; Mitsuo Higashi, all of Uenomachi, Japan

[73] Assignee: Nippon Steel Corporation, Tokyo, Japan

[21] Appl. No.: 576,432

[22] Filed: May 12, 1975

Related U.S. Application Data

[63] Continuation of Ser. No. 378,412, July 12, 1973, abandoned, which is a continuation-in-part of Ser. No. 170,290, Aug. 9, 1971, abandoned, which is a continuation-in-part of Ser. No. 783,766, Dec. 13, 1968, abandoned.

[30] Foreign Application Priority Data

| | | |
|---|---|---|
| Dec. 23, 1967 | Japan | 42-82562 |
| Dec. 23, 1967 | Japan | 42-8263 |
| Dec. 23, 1967 | Japan | 42-8264 |
| Nov. 29, 1968 | Japan | 43-85019 |

[51] Int. Cl.[2] ..... B05D 5/04; B05D 7/14; B32B 15/18

[52] U.S. Cl. ..... 428/341; 428/457; 428/467; 428/470

[58] Field of Search ..... 428/341, 457, 467, 470; 106/14

[56] References Cited

U.S. PATENT DOCUMENTS

| | | | |
|---|---|---|---|
| 2,186,018 | 1/1940 | Griesinger | 428/457 |
| 2,293,580 | 8/1942 | Walker | 428/341 |
| 2,339,200 | 1/1944 | Sowa | 428/457 X |
| 2,564,423 | 8/1951 | Barnum | 106/14 |
| 2,884,338 | 8/1959 | Jenison | 428/457 X |
| 3,035,926 | 5/1962 | Larrieu | 106/14 |

*Primary Examiner*—James R. Hoffman
*Attorney, Agent, or Firm*—Toren, McGeady and Stanger

[57] ABSTRACT

Method for surface treatment of steel sheet which comprises coating the steel sheet with 5 - 200 mg/m$^2$ of a treating solution consisting essentially of at least one member of the group consisting of linseed oil, cottonseed oil, dioctyl sebacate glycol mono-oleate, and glycol di-oleate and a mineral oil, the mineral oil constituting about 0.5 - 15% by volume of the solution.

19 Claims, No Drawings

METHOD FOR SURFACE TREATMENT OF STEEL SHEET AND STEEL SHEETS OBTAINED THEREFROM

This is a continuation of application Ser. No. 378,412, filed July 12, 1973, which, in turn, was a continuation-in-part application of Ser. No. 170,290, filed Aug. 9, 1971, which, in turn, was a continuation of Ser. No. 783,766, filed Dec. 13, 1968, all of said prior applications being now abandoned.

The present invention relates to a process for surface treatment of steel sheet or strip (hereinafter called simply as steel sheet) which is suitable for direct painting and printing without any pre-treatment and at the same time gives rust preventiveness.

The present invention is especially effective for surface treatment of various steel products, such as, hot rolled steel sheet, acid pickled or cold rolled steel sheet as temper rolled, with or without an aqueous rolling solution.

These steel sheets are manufactured at a steel works and are usually transported by ship or stocked for a long periods, e.g. as long as one month or more before they are painted or printed at the users. Therefore, it is necessary to coat the steel sheets with a rust preventive oil as a temporary treatment in order to prevent rust formation during the transportation or stocking.

Conventionally, 1 - 4 g/m$^2$ of rust preventive oils, composed mainly of mineral oil, are applied on the steel sheets for this purpose.

However, the steel sheets coated as above are not suitable for direct painting and printing without a pre-treatment.

Therefore, the pre-treatments, such as, alkali degreasing, solvent degreasing, acid pickling, conversion treatment, etc. are indispensable, and thus additional processes and expenses are required.

On the contrary, the dried steel sheets which are not coated with rust preventive oils are suitable for direct painting and printing, but in this case, rust formation during the transportation, etc., can not be prevented even if the sheets are packed closely together.

Therefore, a new process for surface treatment of steel sheets which is suitable for direct painting and printing and at the same time gives rust prevention has long been demanded and the present invention realizes the demand.

Thus, the main object of the present invention is to provide a new process for surface treatment of steel sheets which is suitable for direct painting and printing without any pre-treatment.

Other objects and advantages of the present invention will be understood by the following description.

The requisites for surface treatment of steel sheets which is suitable for painting and printing are outlined as follows.

The first requisite is that paint, lacquer or ink can be applied uniformly on the surface of steel sheets by using the usual methods, such as, a roller coating or spray coating method.

In this point, the conventional rust preventing treatment of steel sheets, that is, the coating of rust preventive oils composed mainly of mineral oils can not satisfy the first requisite. Namely, the steel sheet which is treated by the conventional rust preventing treatment can not be applied with paint or lacquer or ink at all without pretreatment, though depending on the amount of the applied oils, and defects in the coating, such as, uneveness in the coating or pinhole or cissing etc., take place.

This is due to the fact that the surface tension of the rust preventive oils composed mainly of mineral oils is smaller than the surface tension of the paint, lacquer or ink which is usually applied to steel sheets.

The surface tension of the latter is about 24 - 32 dyne/cm, though it depends on the types or the thinner formulation.

Therefore, it is apparently presumed that the first requisite will be satisfied if the material having the surface tension of more than 30 dyne/cm at least is coated on to steel sheets.

The second requisite is that the adhesion of paint, lacquer or ink for the steel sheets is not spoiled.

The degree of the adhesion is determined by the strength of the direct combining power of the paint lacquer or ink with the surface of steel sheets and the density of the combining media.

When the coating materials for rust prevention lies on the surface boundary between the steel sheet and the paint or lacquer or ink, the adhesion is decreased to the degree that the direct combination of the paint, etc., is lowered.

After various extensive examinations and studies, it has been found that the adhesion is not spoiled only in the case when the coating materials lying on the surface boundary have solubility with the paint, etc., and moves into the paint, etc., during the baking of the paint.

Accordingly, whether the coating material for rust prevention of steel sheets has solubility with the paint, is an important factor.

The third requisite is that the coating material for rust prevention of steel sheets does not react with the paint, lacquer or ink.

It is necessary that the coating material does not cause shortness of hardness of the paint, etc., or decoloration of the paint, etc., by interfering with the hardening reaction of the paint, etc.

After various examinations and studies in view of the above mentioned, it has been found that the ester of a fatty acid having 1 - 2 carboxyl groups and mono- or polyvalent alcohol satisfies the said three requisites as the coating material for rust prevention of the steel sheets and does not harm the painting or printing. However the ester must be applied in a limited amount on steel sheets in order to satisfy the requisites for painting or printing.

One of the features of the present invention lies in that at least one ester of an unsaturated or saturated fatty acid containing 6 - 20 carbon atoms (including carbon of carboxyl group) and 1 - 2 carboxyl groups with mono- or poly-valent alcohol containing 3 - 20 carbon atoms, such as dioctyl sebacate (hereinafter called DOS), glycol monooleate and glycol dioleate for example, or a substance containing such ester and fatty acid, such as, cotton-seed oil and linseed oil, are used as a surface treating agent and such surface treating agent together with a suitable fluidity adjusting agent and/or rust preventive oil and are applied in the amount of 2 - 200mg/m$^2$ on a steel sheet which has been temper rolled or applied on a hot rolled steel sheet as acid pickled, or such surface treating agent alone may be applied in the amount of 5 - 200mg/m$^2$ on a steel sheet which has been temper rolled with an aqueous solution to attain the above object of the present invention. As for the ester, it may be a mono-ester or diester when the carboxylic group is dibasic.

The kinds of the esters which are the main components of the surface treating agent according to the present invention are subjected to certain limitations in respect to the rust preventing property and the working property.

An ester of fatty acid containing not more than 5 carbon atoms or an ester of alcohol containing not more than 2 carbon atoms is not suitable as the main component of the surface treating agent as it has a poor rust preventing property or it is volatile.

An ester of fatty acid containing 21 or more carbon atoms or an ester of an alcohol containing 21 or more carbon atoms can not be applied on steel sheets by using the conventional method, such as a spray or electrostatic painting method, as it has extremely high viscosity even when it is heated or a fluidity adjusting agent is used.

An esters of a fatty acid containing 6 – 20 carbon atoms and alcohol containing 3 – 20 carbon atoms have a little differences in respect with the working property and the rust preventing property.

Namely, for example, di-octyl sebacate (hereinafter called as "DOS") has a relatively good working property and it is easy to obtain a uniform coating by using the spray or electrostatic painting method, but DOS is relatively inferior in respect of the rust preventing property.

On the other hand, for example, glycol mono-oleate and glycol di-oleate are relatively poor in respect to the working property and have to be heated or helped by a fluidity adjusting agent. But as they have relatively a good rust preventing property, it is possible that these esters are used alone depending on the coating conditions or are used by mixing at a given proportion.

It is desirable that the viscosity of the surface treating agents of the present invention is not more than 100 centipoise when the surface treating agents are used.

Among the features of the present invention, the amount of the surface treating agent applied on the steel sheets is very important.

The object of the present invention is to provide a new treating method for the rust prevention of steel sheets which are suitable for direct painting or printing without any pre-treatments and, as has been already mentioned above, the esters which are the main component of the surface treating agent in the present invention satisfy the object, but the esters are suitable for the object only in the case when the surface treating agent is applied in a very thin layer on steel sheets, that is, not more than 200mg/m$^2$.

When the amount of the surface treating agent is applied in an amount more than 200mg/m$^2$, the object of the present invention can not be attained as the thickness of the coating film of the paint, etc., can not be made uniform and defects, such as, pinhole or cissing often take place and further the adhesion of the coated film is poor.

As mentioned above, in the present invention the rust preventing property is slightly decreased as the coating amount of the surface treating agent is severly limited in order to satisfy the painting property.

However, as compared with the conventional, temporary treatment for rust preventing wherein 1 – 4g/m$^2$ of rust preventive oils composed mainly of mineral oil is applied to steel sheets, the surface treatment of the present invention is superior to the conventional temporary treatment for rust preventing, because the surface treatment of the present invention has much better merit in respect to the painting property though this treatment has a somewhat inferior but satisfactory rust preventing property.

In case of steel sheet which has been temper rolled with an aqueous solution, the surface treating agent is applied to such a steel sheet in an amount of 5 – 200mg/m$^2$. Less than 5mg/m$^2$ is not effective for preventing rust while with more than about 200mg/m$^2$, it is sometimes required to remove the coated agent prior to painting, etc.

When the steel sheet is temper rolled with an aqueous solution, a sufficient rust preventive effect can be maintained so far as the aqueous solution for rolling is maintained in a wet condition on the steel surface, but if the aqueous solution is dried, severe rust formation often takes place.

By applying the present inventive surface treating agent on the steel sheet which has been temper rolled with an aqueous solution it can be assured that the aqueous solution applied during the temper rolling is maintained in a wet condition for a long time, thus greatly improving the rust preventive effects.

In the case of a steel sheet which has been temper rolled without aqueous solution, and a hot rolled steel sheet as acid pickled, the surface of such steel sheets are not coated with the aqueous solution and thus, it is required to coat a greater amount of the present surface treating agent in a finer and uniform condition to obtain good rust prevention effects. For this purpose, a fluidity adjusting agent is added to the surface treating agent. As the fluidity adjusting agent, one can use mineral oil, such as, machine oil and spindle oil which lowers the viscosity of the surface treating agent, thus making it easier to apply on the steel surface, improves the spreadability of the surface treating agent applied by a spray method, and increases the solubility of various rust preventives mentioned hereinafter in the surface treating agent such as DOS, cotton-seed oil and linseed oil, etc. The fluidity adjusting agent may be added in an amount of about 0.5 – 15% by volume. Less than about 0.5% gives almost no effect, and a temperature lower than about 10° C, it often partialy condenses, thus lowering its fluidity and increasing its viscosity, and thus it is difficult to coat the surface treating agent in a very small amount and uniformly. With more than about 15%, its rust preventive effect and the intersolubility of the coated surface treating agent with the paint is lowered, and degreasing is required prior to painting and printing.

With the addition of the fluidity adjusting agent in the above specified range, it is possible to coat the surface treating agent in a very small amount and uniformly and direct painting and printing are made possible without the requirement of pre-removal of thus coated surface treating agent. The amount of the treating solution containing the surface treating agent and the fluidity adjusting agent to be applied to the steel surface is desirably 5 – 200mg/m$^2$ for the reasons described before in case of the steel sheet which has been temper rolled with an aqueous solution.

When the above treating solution containing the surface treating agent, such as, DOS, cotton-seed oil, linseed oil, glycol mono-oleate or glycol di-oleate and a fluidity adjusting agent is applied to the steel sheet which has been temper rolled with an aqueous solution, still better results can be obtained than when the surface treating agent, such as, DOS, cotton-seed oil, linseed oil, glycol mono-oleate or glycol di-oleate, alone is applied to such steel sheet, and when the above treating solution is applied to a steel sheet which has been temper rolled without an aqueous solution.

To obtain still better results, one may use the treating solution containing the surface treating agent, such as, DOS, cotton-seed oil, linseed oil, glycol mono-oleate and glycol di-oleate, and the fluidity adjusting agent with the addition of oil-soluble rust preventives. In this way, a better rust preventive effect can be obtained and the required amount of solution to be coated is reduced and the paint adhesion is improved.

As for the oil-soluble rust preventives, volatile rust preventives are desirable and such substances as organic carboxylic acids and their salts, aliphatic amines are used. For example "VERSON" (tradename) produced by Daiwa Kasei K.K. of Japan may be used.

In case the organic carboxylic acids and their salts and aliphatic amines are dissolved in a mineral oil as in the case of "VERSON", this mineral oil (constituting about 70% by volume) can substitute the mineral oil used as the fluidity adjusting agent, thus assuring a uniform coating of the solution in a very small amount.

In this way, rust which would otherwise take place at possible breaks of the coating film due to the very small amount of the coating can be prevented advantageously. Namely, after the treating solution is applied on the steel surface, the volatile oil-soluble rust preventive added to the solution will vaporize and fill up the breaks of the film and form a favourable film thereon, thus preventing the rust formation.

The amount of the volatile oil-soluble rust preventive to be added to the solution should be enough to form the fresh film on the film breaks, and thus about 0.5 – 10% by volume is desirable.

Instead of the above mentioned fluidity adjusting agent, the following oil-soluble rust preventives can be added to the surface treating agent such as DOS, cotton-seed oil, linseed oil, glycol mono-oleate or glycol di-oleate, and in this case the solution can be a given desirable fluidity by heating, and thus the solution can be applied on the steel surface relatively uniformly. The solution should be heated to a temperature suitable for coating on the steel surface; thus a temperature between 30° – 70° C is desirable. At lower than 30° C, the solution will have too high a viscosity and will be difficult to coat uniformly, thus often allowing rust formation. While above 70° C, the solution will lose stability and rust preventive effect.

As for the oil-soluble rust preventives used in the present invention, carboxylic acids and salt inhibitors, such as "VERSON", ester inhibitors, basic nitride inhibitors, sulfonate inhibitors, phosphate and thiophosphate inhibitors and aliphatic amine inhibitors may be used.

As for carboxylic acid and salt inhibitors used in the present invention, in addition to the above mentioned "VERSON", dicyclohexylammonium caprylate, dicyclohexylammonium carbamate, stearic acid triethanolamine salt, metallic salts of wool-fatty acid, metallic salts of abietic acid, cyclohexylamine carbonate, etc., may be used.

As for ester inhibitors, for example, sorbitan mono-oleate and pentaerythritol mono-oleate may be used. As for basic nitride inhibitors, for example, dicyclohexylammonium nitride may be used.

As for sulfonate inhibitors, for example, the barium salt of octadecyclbenzenesulfonic acid, the calcium salt of petroleum sulfonic acid, etc., may be used.

As for phosphate and thio-phosphate inhibitors, for example, the calcium salt of reaction products of alkylphenol with phosphorus pentasulfide, mono-, di- or trialkyl phosphite, etc., may be used.

As for aliphatic amine inhibitors, for example, dicyclohexylamine, morpholine, isopropanolamine, condensates of alkylamine with unsaturated fatty-acid, etc., may be used.

The above oil-soluble rust preventives are added desirably in an amount of 0.5 – 10%. With less than about 0.5%, almost no effect is obtained and on the other hand with more than about 10%, good painting can not be assured because the paint will be repelled by the coated solution and thus it is necessary to remove the coated solution.

Concludingly, the treating solution comprising the surface treating agent, such as, DOS, cotton-seed oil or linseed oil with the addition of fluidity adjusting agent and oil-soluble rust preventives, or the heated treating solution comprising the surface treating agent such as DOS, cotton-seed oil, glycol mono-oleate and glycol di-oleate with addition of oil-soluble rust preventives is applied in an amount of about 2 – 100mg/m$^2$ to a hot rolled steel sheet such as acid pickled, or steel sheet as temper rolled with or without an aqueous solution. However, in the case of a steel sheet which has been temper rolled with an aqueous solution as mentioned before, the treating solution containing the surface treating agent, such as, DOS, cotton-seed oil or linseed oil alone can be applied to such steel sheets for obtaining desired results.

As for the method for applying the present treating solution to the steel sheet, it can be applied by any known method, but better results can be obtained by air-spraying or electrostatic oiling.

Steel sheets coated with the treating solution are piled or coiled for transportation and storing, during which remarkable rust preventive effects are maintained for a long time, and can be directly painted or printed without removal of the coated surface treating solution.

The present invention will be fully understood through the examples, the results of which are tabulated below.

| Example No. | Sheet Conditions | Surface Treating Agent | | | Fluidity Adjusting Agent | |
|---|---|---|---|---|---|---|
| | | DOS | Cotton-seed oil | Linseed oil | Type | Amount % |
| 1 | Hot rolled acid pickled | o | — | — | Spindle oil | 15 |
| 2 | Hot rolled acid pickled | — | o | — | Machine oil | 3 |
| 3 | Cold rolled dry temper rolled | o | — | — | Spindle oil | 5 |

-continued

| Example No. | Sheet Conditions | Surface Treating Agent DOS | Cotton-seed oil | Linseed oil | Fluidity Adjusting Agent Type | Amount % |
|---|---|---|---|---|---|---|
| 4 | same as 3 | o | — | — | Machine oil | 2 |
| 5 | same as 3 | — | o | — | Spindle oil | 4 |
| 6 | Hot rolled acid pickled | o | — | — | Spindle oil | 5 |
| 7 | same as 6 | — | — | o | Spindle oil | 7 |
| 8 | same as 6 | — | — | o | Spindle oil | 12 |
| 9 | Cold rolled dry temper rolled | o | — | — | Spindle oil | 0.7 |
| 10 | same as 9 | o | — | — | Machine oil | 4 |
| 11 | Hot rolled | — | o | — | Machine oil | 6 |
| 12 | same as 11 | o | — | — | — | — |
| 13 | same as 11 | — | — | o | — | — |
| 14 | same as 11 | — | — | o | — | — |
| 15 | Cold rolled dry temper rolled | o | — | — | — | — |
| 16 | same as 15 | o | — | — | — | — |
| 17 | Hot rolled acid pickled | — | o | — | — | — |
| 18 | Cold rolled wet temper rolled A | o | — | — | — | — |
| 19 | same as 18 | 99.8% of DOS plus glycol mono-oleate glycol di-oleate | | | — | — |
| 20 | Cold rolled wet temper rolled B | — | — | o | — | — |
| 21 | same as 18 | o | — | — | Machine oil | 0.7 |
| 22 | same as 18 | o | — | — | Machine oil | 12 |
| 23 | same as 18 | — | — | o | Spindle oil | 7 |
| 24 | same as 18 | same as 19 | | | Machine oil | 7 |
| 25 | same as 20 | o | — | — | Machine oil | 10 |
| 26 | same as 18 | o | — | — | Machine oil | 7 |
| 27 | same as 18 | — | — | o | Spindle oil | 13 |
| 28 | same as 18 | — | o | — | Machine oil | 3 |
| 29 | same as 18 | — | o | — | Spindle oil | 5 |
| 30 | same as 18 | same as 19 | | | Machine oil | 7 |
| 31 | same as 20 | same as 19 | | | Machine oil | 6.5 |
| 32 | same as 18 | o | — | — | — | — |
| 33 | same as 18 | — | — | o | — | — |
| 34 | same as 18 | — | o | — | — | — |
| 35 | same as 18 | — | o | — | — | — |
| 36 | same as 18 | same as 19 | | | — | — |
| 37 | same as 11 | glycol mono-oleate | | | Machine oil | 10 |
| 38 | same as 15 | same as 37 | | | Spindle oil | 12 |
| 39 | same as 18 | same as 37 | | | Machine oil | 2 |
| 40 | same as 20 | same as 37 | | | — | — |
| 41 | same as 11 | glycol di-oleate | | | Spindle oil | 12 |
| 42 | same as 15 | same as 41 | | | Machine oil | 15 |
| 43 | same as 18 | same as 41 | | | Machine oil | 7 |
| 44 | same as 20 | same as 41 | | | Spindle oil | 9 |
| 45 | same as 11 | DOS 50%, glycol mono-oleate 30%, glycol di-oleate 20% | | | Machine oil | 11 |
| 46 | same as 15 | same as 45 | | | Spindle oil | 8 |
| 47 | same as 18 | same as 45 | | | Machine oil | 4 |
| 48 | same as 20 | same as 45 | | | Machine oil | 1 |
| 49 | Cold rolled wet temper rolled C | same as 19 | | | — | — |
| 50 | same as 49 | linseed oil | | | Spindle oil | 3 |
| 51 | same as 49 | same as 37 | | | Machine oil | 10 |
| 52 | same as 49 | same as 45 | | | Machine oil | 9 |

| Ex. No. | Rust Preventive Type | Amount % | Temperature of Treating Sol. ° C | Amount of Coating mg/m² |
|---|---|---|---|---|
| 1 | — | — | 20–25 | 140 |
| 2 | — | — | 20–25 | 190 |
| 3 | — | — | 20–25 | 80 |
| 4 | — | — | 20–25 | 60 |
| 5 | — | — | 20–25 | 120 |
| 6 | — | — | 20–25 | 80 |
| 7 | VERSON | 7 | 20–25 | 50 |
| 8 | VERSON | 8 | 20–25 | 60 |
| 9 | VERSON | 5 | 20–25 | 25 |
| 10 | VERSON | 10 | 20–25 | 50 |
| 11 | VERSON | 1 | 20–25 | 70 |
| 12 | ethylene diamine and sorbitan mono-oleate | 4 | 52 | 80 |
| 13 | dicyclohexyl ammonium nitrite | 0.7 | 60 | 50 |
| 14 | dicyclohexyl amine and barium salt of octadecyl benzene sulfonic acid | 8 | 70 | 60 |

-continued

| Ex. No. | Rust Preventive Type | Amount % | Temperature of Treating Sol. ° C | Amount of Coating mg/m² |
|---|---|---|---|---|
| 15 | methanol sol. of 20% dicyclohexl ammonium nitrite | 5 | 40 | 25 |
| 16 | morpholine and octadecylamine | 10 | 57 | 50 |
| 17 | cyclohexyl amine carbonate | 1 | 48 | 70 |
| 18 | — | — | 20–25 | 30 |
| 19 | — | — | 20–25 | 7 |
| 20 | — | — | 20–25 | 30 |
| 21 | — | — | 20–25 | 20 |
| 22 | — | — | 20–25 | 7 |
| 23 | — | — | 20–25 | 30 |
| 24 | — | — | 20–25 | 10 |
| 25 | — | — | 20–25 | 20 |
| 26 | VERSON | 2 | 20–25 | 5 |
| 27 | VERSON | 3 | 20–25 | 7 |

-continued

| Ex. No. | Rust Preventive Type | Rust Preventive Amount % | Temperature of Treating Sol. ° C | Amount of Coating mg/m² |
|---|---|---|---|---|
| 28 | VERSON | 8 | 20–25 | 20 |
| 29 | VERSON | 5 | 20–25 | 40 |
| 30 | VERSON | 2 | 20–25 | 5 |
| 31 | VERSON | 3 | 20–25 | 7 |
| 32 | cyclohexyl carbonate | 0.5 | 32 | 5 |
| 33 | stearic acid triethanol amine salt | 3 | 45 | 7 |
| 34 | methanol sol. of 20% dicyclohexyl ammonium nitrite | 8 | 64 | 60 |
| 35 | octadecylamine salt | 6 | 67 | 40 |
| 36 | cyclohexylamine carbonate | 2 | 41 | 5 |
| 37 | calcium salt of wool-fatty acid | 2 | 40 | 80 |
| 38 | dicyclohexylammonium caprylate | 5 | 60 | 60 |
| 39 | isopropanolamine | 8 | 60 | 45 |
| 40 | VERSON | 6 | 65 | 35 |
| 41 | calcium salt of petroleum sulfonic acid | 3 | 50 | 100 |
| 42 | dicyclohexylammonium carbonate | 7 | 55 | 25 |
| 43 | pentaerythritol mono-oleate | 7 | 70 | 15 |
| 44 | condensates of alkylamine with unsaturated fatty-acid | 4 | 70 | 40 |
| 45 | calcium salt of reaction products of alkylphenol with phosphorus pentasulfide | 2 | 20–25 | 90 |
| 46 | barium salt of abietic acid | 3 | 40 | 30 |
| 47 | trialkyl phosphite | 5 | 40 | 10 |
| 48 | barium salt of octadecylbenzenesulfonic acid | 6 | 60 | 5 |
| 49 | VERSON | 10 | 20–25 | 15 |
| 50 | dicyclohexylammonium caprylate | 3 | 40 | 30 |
| 51 | morpholine and octadecylamine | 8 | 60 | 25 |
| 52 | VERSON | 1 | 60 | 140 |

Test Results

| Example No. | Rust Formation | Painting or Printing Type | Painting or Printing Amount | Paintability | Paint Adhesion |
|---|---|---|---|---|---|
| 1 | o | melamine alkyd | 26 | o | o |
| 2 | ◎ | same | 27 | o | o |
| 3 | o | same | 27 | ◎ | o |
| 4 | o | same | 28 | ◎ | ◎ |
| 5 | o | same | 28 | o | o |
| 6 | o | same | 26 | ◎ | ◎ |
| 7 | ◎ | same | 26 | ◎ | ◎ |
| 8 | ◎ | same | 27 | o | ◎ |
| 9 | o | same | 27 | ◎ | ◎ |
| 10 | ◎ | same | 28 | ◎ | o |
| 11 | o | same | 29 | ◎ | ◎ |
| 12 | o | same | 26 | ◎ | ◎ |
| 13 | o | same | 26 | ◎ | ◎ |
| 14 | ◎ | same | 26 | ◎ | o |
| 15 | o | same | 27 | ◎ | ◎ |
| 16 | o | same | 28 | ◎ | ◎ |
| 17 | o | same | 29 | ◎ | ◎ |
| 18 | o | same | 28 | ◎ | ◎ |
| 19 | o | printing: linseed oil modified phenol resin | — | ◎ | ◎ |
| 20 | o | same as 19 | — | o | o |
| 21 | o | melamine alkyd | 252 | ◎ | ◎ |
| 22 | ◎ | melamine alkyd | 25 | ◎ | ◎ |
| 23 | ◎ | melamine alkyd | 26 | ◎ | ◎ |
| 24 | ◎ | melamine alkyd | 29 | ◎ | ◎ |
| 25 | ◎ | melamine alkyd | 25 | o | o |
| 26 | ◎ | melamine alkyd | 25 | ◎ | ◎ |
| 27 | ◎ | melamine alkyd | 25 | ◎ | ◎ |
| 28 | ◎ | same as 19 | — | o | o |
| 29 | ◎ | melamine alkyd | 29 | ◎ | ◎ |
| 30 | o | melamine alkyd | 30 | ◎ | ◎ |
| 31 | o | same as 19 | — | ◎ | o |
| 32 | o | melamine alkyd | 25 | ◎ | ◎ |
| 33 | ◎ | melamine alkyd | 25 | ◎ | ◎ |

Test Results-continued

| Example No. | Rust Formation | Painting or Printing Type | Painting or Printing Amount | Paintability | Paint Adhesion |
|---|---|---|---|---|---|
| 34 | ◎ | melamine alkyd | 28 | ◎ | ◎ |
| 35 | ◎ | melamine alkyd | 29 | ◎ | ◎ |
| 36 | ◎ | melamine alkyd | 30 | ◎ | ◎ |
| 37 | ◎ | melamine alkyd | 25 | o | ◎ |
| 38 | ◎ | same as 19 | — | ◎ | ◎ |
| 39 | o | melamine alkyd | 25 | ◎ | ◎ |
| 40 | ◎ | melamine alkyd | 20 | ◎ | ◎ |
| 41 | ◎ | melamine alkyd | 20 | o | o |
| 42 | ◎ | melamine alkyd | 28 | ◎ | ◎ |
| 43 | o | same as 19 | — | ◎ | o |
| 44 | ◎ | melamine alkyd | 25 | ◎ | ◎ |
| 45 | ◎ | same as 19 | — | o | ◎ |
| 46 | ◎ | melamine alkyd | 30 | ◎ | o |
| 47 | o | melamine alkyd | 25 | ◎ | ◎ |
| 48 | o | melamine alkyd | 25 | ◎ | ◎ |
| 49 | ◎ | melamine alkyd | 25 | ◎ | ◎ |
| 50 | ◎ | melamine alkyd | 25 | ◎ | ◎ |
| 51 | ◎ | melamine alkyd | 25 | ◎ | ◎ |
| 52 | ◎ | melamine alkyd | 25 | o | ◎ |

Comparative Tests

| Test No. | Sheet Conditions | Surface Treating Agent DOS | Surface Treating Agent Cotton-seed oil | Surface Treating Agent Linseed oil | Fluidity Adjusting Agent Type | Fluidity Adjusting Agent Amount |
|---|---|---|---|---|---|---|
| 1 | Hot rolled acid pickled | o | — | — | Spindle oil | 4 |
| 2 | Cold rolled dry temper rolled | — | o | — | Machine oil | 3 |
| 3 | Cold rolled wet temper rolled A | o | — | — | Machine oil | 12 |
| 4 | Cold rolled wet temper rolled B | — | — | o | Machine oil | 4 |
| 5 | same as 1 | — | o | — | Spindle oil | 7 |
| 6 | same as 3 | o | — | — | — | — |
| 7 | same as 1 | — | o | — | — | — |
| 8 | same as 2 | o | — | — | — | — |
| 9 | same as 3 | o | — | — | — | — |
| 10 | same as 4 | — | — | o | — | — |

| Test No. | Rust Preventive Type | Rust Preventive Amount % | Temperature of Treating sol. ° C | Amount of Coating mg/m² |
|---|---|---|---|---|
| 1 | — | — | — | 3 |
| 2 | — | — | — | 3 |
| 3 | — | — | — | 1 |
| 4 | VERSON | 0.7 | — | 1 |
| 5 | VERSON | 10 | — | 1 |
| 6 | cyclohexyl amine | 0.7 | 60 | 1 |
| 7 | cyclohexyl amine | 0.7 | 60 | 250 |
| 8 | cyclohexyl carbonate | 1 | 48 | 250 |
| 9 | cyclohexyl carbonate | 1 48 | 250 | |
| 10 | cyclohexyl carbonate | 1 | 48 | 250 |

| Test No. | Rust Formation | Painting & Printing | Paintability | Paint Adhesion |
|---|---|---|---|---|
| 1 | x | no test was done due to severe rust formation | | |
| 2 | x | | | |
| 3 | x | | | |
| 4 | x | | | |
| 5 | x | | | |
| 6 | x | | | |
| 7 | o | melamine alkyd | x | x |
| 8 | ◎ | same | x | x |
| 9 | ◎ | same | x | x |

-continued

| Test No. | Rust Formation | Painting & Printing | Paintability | Paint Adhesion |
|---|---|---|---|---|
| 10 | ◎ | same | x | x |

Remarks

Wet temper rolled A:

Sheet was temper rolled using an aqueous solution mixed with water at 1 : 9; said aqueous solution containing 30% of sodium nitrate, 10% of amphotericion surfactant (alanine) a small amount of organic amine and the remainder being water.

Wet temper rolled B:

Sheet was temper rolled using an aqueous solution mixed with water at 1 : 9; said aqueous solution containing 30% of sodium nitrite, 30% of amine rust preventive and amine non-ionic surfactant and the remainder being water.

Wet temper rolled C:

Sheet was temper rolled using an aqueous solution mixed with water at 1 : 9; said aqueous solution containing 15% benzoic acid, 15% aliphatic amine, 3% aqueous rust inhibitors and a small amount of surfactant and the remainder being water.

Rust formation:

Sheet was surface treated, packed with craft paper and left at 50° C, 98% moisture for two weeks.

o: completely no rust formation o: some indication of partial rust formation x: means severe rust formation Paintability:

o: satisfactory paintability o: paint is slightly repelled but good enough for practical use x: paint is repelled and almost no painting can be effected Paint adhesion:

o: completely no problem for practical use o: enough for all practical use other than applications where very high paint adhesion is needed x: not enough for practical use

What is claimed is:

1. Method for surface treatment of steel sheet which comprises coating the steel sheet with 5 – 200mg/m$^2$ of a treating solution consisting essentially of at least one member of the group consisting of linseed oil, cottonseed oil and dioctyl sebacate and a mineral oil, the mineral oil constituting about 0.5 – 15% by volume of the solution whereby said sheet can be directly painted or printed without a prior degreasing.

2. Method for surface treatment of steel sheet which comprises coating the steel sheet with 5 – 200mg/m$^2$ of a treating solution consisting essentially of dioctyl sebacate, glycol mono-oleate and glycol di-oleate, wherein the glycol portion is a mono or polyvalent alcohol having from 3 to 20 carbon atoms, and a mineral oil, the mineral oil constituting about 0.5 – 15% by volume of the solution whereby said sheet can be directly painted or printed without a prior degreasing.

3. Method for surface treatment of steel sheet which comprises coating the steel sheet with 2 – 100mg/m$^2$ of a treating solution consisting essentially of at least one member of the group consisting of linseed oil, cottonseed oil and dioctyl sebacate and at least one oil soluble rust inhibitor, the rust inhibitor constituting about 0.5 – 10% by volume of the solution whereby said sheet can be directly painted or printed without a prior degreasing.

4. A method for the surface treatment of a steel sheet which comprises coating a steel sheet with 2 – 100 mg/m$^2$ of a treating solution consisting essentially of an ester selected from the group consisting of dioctyl sebacate, glycol mono-oleate, glycol di-oleate, wherein the glycol portion is a polyvalent alcohol having from 3 to 20 carbon atoms, and combinations thereof, and at least one oil soluble rust inhibitor, the rust inhibitor constituting about 0.5 – 10% by volume of the solution whereby said sheet can be directly painted or printed without a prior degreasing.

5. Method for surface treatment of steel sheet which comprises coating the steel sheet with 2 – 100mg/m$^2$ of a treating solution consisting essentially of at least one member of the group consisting of linseed oil, cottonseed oil and dioctyl sebacate, a mineral oil, and at least one oil soluble rust inhibitor, the mineral oil constituting about 0.5 – 15% by volume of the solution and the rust inhibitor constituting about 0.5 – 10% by volume of the solution whereby said sheet can be directly painted or printed without a prior degreasing.

6. Method for surface treatment of steel sheet which comprises coating the steel sheet with 2 – 100 mg/m$^2$ of a treating solution consisting essentially of dioctyl sebacate, glycol mono-oleate, glycol di-oleate, wherein the glycol portion is a polyvalent alcohol having from 3 to 20 carbon atoms, a mineral oil, and at least one oil soluble rust inhibitor, the mineral oil constituting about 0.5 – 15% by volume of the solution and the rust inhibitor constituting about 0.5 – 10% by volume of the solution whereby said sheet can be directly painted or printed without a prior degreasing.

7. Method according to claim 3, in which the rust inhibitor is selected from the group consisting of carboxylic acid, carboxylic acid salts, esters, basic nitrites, phosphates, thiophosphates and aliphatic amines.

8. Method according to claim 4, in which the rust inhibitor is selected from the group consisting of carboxylic acids, carboxylic acid salts, esters, basic nitrites, sulfonates, phosphates, thiophosphates and aliphatic amines.

9. Method according to claim 5, in which the rust inhibitor is selected from the group consisting of carboxylic acids, carboxylic acid salts, esters, basic nitrites, phosphates, thiophosphates and aliphatic amines.

10. Method according to claim 6, in which the rust inhibitor is selected from the group consisting of carboxylic acids, carboxylic acid salts, esters, basic nitrites, sulfonates, phosphates thiophosphates and aliphatic amines.

11. Steel sheet coated with 5 – 200mg/m$^2$ of a treating solution consisting essentially of at least one member of the group consisting of linseed oil, cottonseed oil and dioctyl sebacate and a mineral oil, the mineral oil constituting about 0.5 – 15% by volume of the solution whereby said sheet can be directly painted or printed without a prior degreasing.

12. Steel sheet coated with 5 – 200 mg/m$^2$ of a treating solution consisting of dioctyl sebacate, glycol mono-oleate and glycol di-oleate, wherein the glycol portion is a mono or polyvalent alcohol having from 3 to 20 carbon atoms, and a mineral oil, the mineral oil constituting about 0.5 – 15% by volume of the solution whereby said sheet can be directly painted or printed without a prior degreasing.

13. Steel sheet coated with 2 – 100mg/m$^2$ of a treating solution consisting essentially of at least one member of the group consisting of linseed oil, cottonseed oil and dioctyl sebacate and at least one oil soluble rust inhibitor, the rust inhibitor constituting about 0.5 – 10% by volume of the solution whereby said sheet can be directly painted or printed without a prior degreasing.

14. A steel sheet coated with 2 – 100mg/m$^2$ of a treating solution consisting essentially of an ester selected from the group consisting of dioctyl sebacate, glycol mono-oleate, glycol di-oleate, wherein the glycol portion is a polyvalent alcohol having from 3 to 20 carbon atoms, and combinations thereof, and at least one oil soluble rust inhibitor, the rust inhibitor constituting about 0.5 – 10% by volume of the solution whereby said sheet can be directly painted or printed without a prior degreasing.

15. Steel sheet coated with 2 – 100mg/m$^2$ of a treating solution consisting essentially of at least one member of the group consisting of linseed oil, cottonseed oil and dioctyl sebacate, a mineral oil, and at least one oil soluble rust inhibitor, the mineral oil constituting about 0.5 – 15% by volume of the solution and the rust inhibitor constituting about 0.5 – 10% by volume of the solution whereby said sheet can be directly painted or printed without a prior degreasing.

16. Steel sheet coated with 2 – 100 mg/m$^2$ of a treating solution consisting essentially of dioctyl sebacate, glycol mono-oleate, glycol di-oleate, wherein the glycol portion is a polyvalent alcohol having from 3 to 20 carbon atoms, a mineral oil and at least one oil soluble rust inhibitor, the mineral oil constituting about 0.5 – 15% by volume of the solution and the rust inhibitor constituting about 0.5 – 10% by volume of the solution whereby said sheet can be directly painted or printed without a prior degreasing.

17. Steel sheet according to claim 13, in which the rust inhibitor is selected from the group consisting of carboxylic acids, carboxylic acid salts, esters, basic nitrites, sulfonate, phosphates, thiophosphates and aliphatic amines.

18. Steel sheet according to claim 14, in which the rust inhibitor is selected from the group consisting of carboxylic acids, carboxylic acid salts, esters, basic nitrites, sulfonate, phosphates, thiophosphates and aliphatic amines.

19. Steel sheet according to claim 15, in which the rust inhibitor is selected from the group consisting of carboxylic acids, carboxylic acid salts, esters, basic nitrites, sulfonate, phosphates, thiophosphates and aliphatic amines.

* * * * *

UNITED STATES PATENT OFFICE

CERTIFICATE OF CORRECTION

Patent No. 4,072,783 Dated February 7, 1978

Inventor(s) Motoi Yasue et al

It is certified that error appears in the above-identified patent and that said Letters Patent are hereby corrected as shown below:

In the heading of the patent [30] should read as follows:

-- [30] Foreign Application Priority Data

December 23, 1967 Japan.....43-82562
December 23, 1967 Japan.....43-82563
December 23, 1967 Japan.....43-82564
November 20, 1968 Japan.....43-85019--.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*

UNITED STATES PATENT OFFICE

CERTIFICATE OF CORRECTION

Patent No. 4,072,783 Dated February 7, 1978

Inventor(s) Motoi Yasue et al

It is certified that error appears in the above-identified patent and that said Letters Patent are hereby corrected as shown below:

In the heading of the patent [30] should read as follows:

-- [30] Foreign Application Priority Data

| | | |
|---|---|---|
| December 23, 1967 | Japan | 42-82562 |
| December 23, 1967 | Japan | 42-82563 |
| December 23, 1967 | Japan | 42-82564 |
| November 20, 1968 | Japan | 43-85019--. |

This certificate supersedes Certificate of Correction issued May 23, 1978.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*